United States Patent [19]

McMillan

[11] 4,136,452

[45] Jan. 30, 1979

[54] METHOD FOR FABRICATING A CUSTOM FIT GARMENT

[75] Inventor: Marguerite R. McMillan, Boulder, Colo.

[73] Assignee: Camp 7, Inc., Longmont, Colo.

[21] Appl. No.: 787,096

[22] Filed: Apr. 13, 1977

[51] Int. Cl.[2] ..... A41H 3/06

[52] U.S. Cl. ..... 33/17 R

[58] Field of Search ..... 33/17 R, 12, 11

[56] References Cited

U.S. PATENT DOCUMENTS 2,131,390 9/1938 Rosenfield ..... 33/12

FOREIGN PATENT DOCUMENTS 128216 10/1927 Switzerland ..... 33/17 R 710354 6/1954 United Kingdom ..... 33/12

*Primary Examiner*—Richard E. Aegerter

*Assistant Examiner*—Willis Little

*Attorney, Agent, or Firm*—Sheridan, Ross, Fields & McIntosh

[57] ABSTRACT

A kit is provided for the fabrication of a custom fit garment. The outline of the individual patterns for the pieces forming the garment are preprinted in spaced relation on one or more lengths of fabric. In turn the pieces form a finished garment when joined according to the instructions provided. The patterns are sized for nominal dimensions with alterations capable of being made in the length and width of the garment by adding or subtracting as much as two inches at each seam. The alterations are preplanned by comparing actual measurements of the wearer with the known finished dimensions of a nominal size garment and properly adjusting the dimensions accordingly. Surplus material provided allows repair of the finished garment or the addition of accessories. This custom fit alteration method can also be applied to the common paper pattern style of garment making.

3 Claims, 5 Drawing Figures

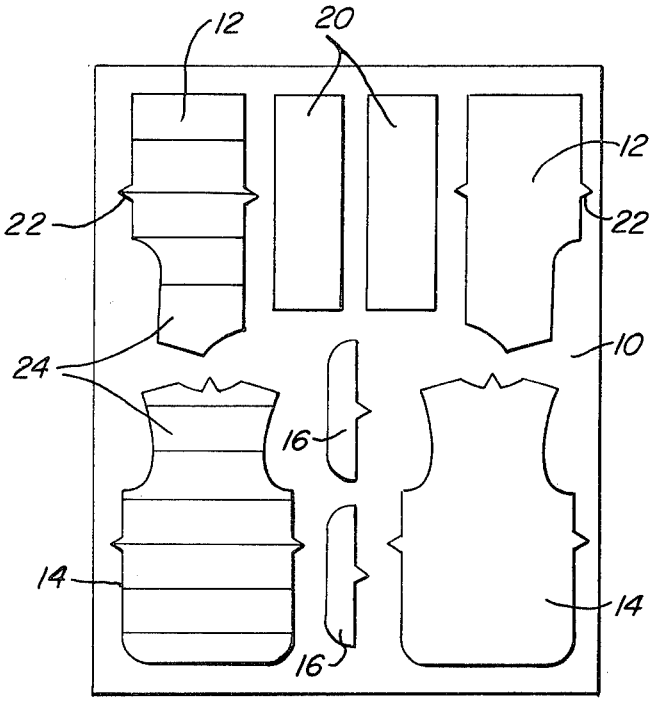
Fig-1
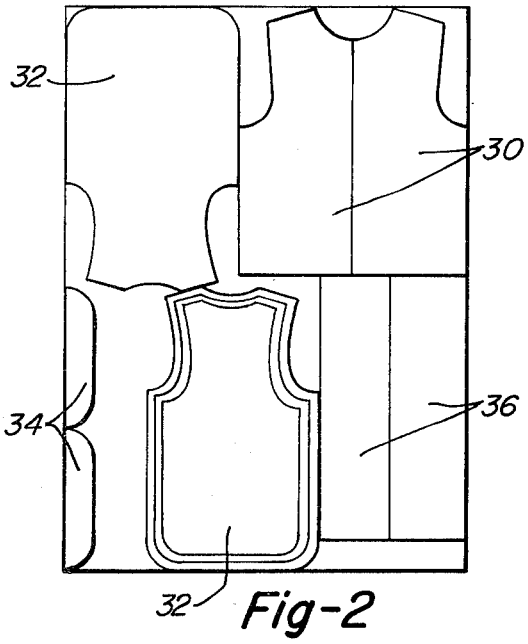
Fig-2
PRIOR ART
SIZE COMPARISON CHART
| SIZE | C-SMALL | C-MED | X-SMALL | SMALL | MED | LG | X-LG |
|---|---|---|---|---|---|---|---|
| MEN | | | | 34-36 | 38-40 | 42-44 | 46-48 |
| WOMEN | | | 6-8 | 8-10 | 12-14 | 14-16 | |
| CHILD | 4-6 | 8-10 | 12-14 | 16-18 | | | |
Fig-3
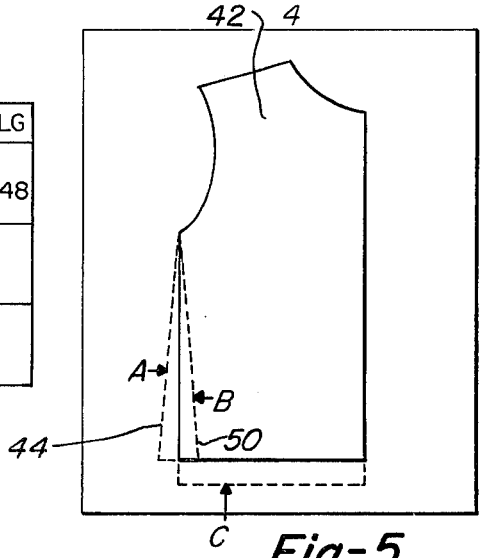
Fig-4
Fig-5
FINISHED INSIDE DIMENSIONS
| SIZE | C-SMALL | C-MED | X-SMALL | SMALL | MED | LARGE | X-LARGE |
|---|---|---|---|---|---|---|---|
| CHEST | 31 | 34 1/2 | 38 | 41 1/2 | 45 | 48 1/2 | 52 |
| BOTTOM EDGE | 31 | 34 | 37 | 39 | 41 | 44 1/2 | 48 |
| BACK LENGTH | 17 | 19 | 21 | 23 | 25 | 27 | 29 |
| COLLAR | 17 | 17 1/2 | 18 1/2 | 19 | 20 | 20 1/2 | 21 |
| POCKET | 5X 5 1/2 | 5 1/2 X 6 | 6 1/2X6 1/2 | 7 1/2 X 7 | 8 1/2 X 7 1/2 | 9" X 8" | 9"X 8 |

METHOD FOR FABRICATING A CUSTOM FIT GARMENT

BACKGROUND OF THE INVENTION

This invention is directed to a garment kit which allows customized fit for the intended wearer. It is more specifically directed to a kit for making garments or other wearing apparel in which the pattern is preprinted in spaced relation on the garment material which allows major alterations to be performed prior to construction.

As is well known in the art to which the present invention is related, kits for making clothing and garments have been known and used for many years. Although it has not been considered a kit in the past, the use of paper patterns has also been well known by seamstresses, tailors and individuals who sew and make articles of clothing. As a variation in the use of paper patterns, the preprinting or precutting of the individual pieces of the garment on or from the intended garment material is also well known.

In viewing the prior art, it is readily apparent that although individuals have confronted the problem of varying the size of garments, little thought has been given to the alteration of garments by enlarging and reducing various dimensions prior to the actual fabrication of the article. There are patents which show patterns having the outline sized for a particular or nominal size. It is suggested in these disclosures that the article can be reduced where desired by shortening or trimming the pattern in order to reduce the dimensions of the individual pieces and in turn the finished article.

In some kits where the individual patterns are preprinted on the material to be used, the individual patterns are arranged in contiguous position on the fabric and the least amount of material possible is provided. In other words, the edges of the individual patterns abut or adjoin each other providing no excess between the pieces. This makes it impossible to enlarge the pattern or the several patterns and thus the overall garment.

This is especially true where the individual pieces have been precut from the fabric prior to being purchased by the individual. Because of the lack of additional material, the pieces can only be reduced in size and never enlarged and thus customized alterations for the finished garment to properly fit the individual wearer is impossible.

It has been noted in the prior art that on some precut or preprinted patterns additional lines have been added to allow making the garment into smaller sizes from the standard or nominal size purchased. Thus, it is necessary that the individual buys the garment according to the largest size required and then reduces the required dimensions of the garment to make a smaller size. This allows reduction in overall size of the garment but it does not allow for increasing certain dimensions for customized alteration and fitting.

It is common knowledge that the vast majority of human beings do not fit into exact or standard sizes. In fact each individual is different in one or many dimensions from many others. Although some persons come close to a nominal size, the vast majority require variations from the nominal. For this reason it is practically impossible to buy a ready-made garment, dress or article of clothing without requiring some alteration to be made to provide a proper and perfect fit.

The same is also true with respect to kits which are provided for individuals to sew and construct for themselves. Although alterations can be made during the construction of these garments, the alterations always have taken the form of reducing or taking in the dimensions to provide a reasonable fit. Nowhere has it been found that the kit allows for the additional enlargement of the pieces in one or more dimensions to provide the necessary proper fit for the wearer.

Because of the above-stated problems, it is an object of the present invention to provide a garment kit wherein the pattern and individual pieces can be enlarged or reduced in various dimensions as required to provide a proper fit for the intended wearer.

It is also an object of the present invention to allow a person who has little skill in the art of making clothing to custom fit the finished article.

It is also a further object of the present invention to provide a garment kit in which an excess of material is included to allow additional accessories to be added or for repair of the finished garment.

It is also a still further object of the present invention to provide kits in several nominal sizes which cover a range of dimensions which permits the individual to vary the required dimensions of his garment for custom fitting.

It is another object of the present invention to provide a kit for making clothing in which the matching of the color between the individual pieces and the loss of individual pieces which occurs with precut kits is eliminated permitting the completion of a well-fitted garment at a reasonable cost.

SUMMARY OF THE INVENTION

The present invention provides a kit for making custom fit clothing, especially outerwear garments, from a set of nominally sized pattern pieces preprinted on the finished fabric. The individual patterns for the pieces of the garment are spaced on the fabric to provide excess material around the outer edges. Each kit provides a nominal size and the various kits are provided to cover the range of anticipated sizes from the small child to the large adult. It is anticipated that this range can be covered by providing kits which cover approximately seven nominal sizes.

The individual buys a kit which closely approximates the nominal size for his chest and shoulder measurements. All other dimensions can be easily varied either larger or smaller or both to provide the exact customized fit that is required by the intended wearer.

A comparison size chart is provided which shows the conversion from the regular sizes provided in ready-made clothing to the kit sizes. The individual purchases a kit having the nominal size for his general measurements. The nominal dimensions shown for the finished article would be obtained if the preprinted pieces are sewn without alteration and in accordance with the instructions. From the given finished dimensions provided, the individual knowing his exact measurements, can vary the corresponding dimensions of each piece such as the sleeve length, body length, waist or hip measurements, etc. By adding or subtracting from the individual patterns prior to the cutting of the pieces from the material, the individual can custom fit his garment at the start.

When providing garments for children, additional sizing for growth is customarily provided. The kit provided by the present invention allows for personal modification of the garments in anticipation of growth according to the individual child. This is to say that where a child is anticipated to grow slowly in certain areas and more rapidly in others, the garment can be custom fabricated to accommodate these anticipated requirements.

It is also possible to apply the present invention to use with a paper pattern type garment fabrication in that they can be spaced on the material with modifications made in the outline of the individual pieces in accordance with the present invention before the actual cutting of the fabric is performed. In this way the necessary alterations can be performed in the same manner as provided for kits prior to the actual sewing of the garment.

BRIEF DESCRIPTION OF THE DRAWINGS

Other features of this invention will appear in the following description and appended claims, reference being made to the accompanying drawing forming a part of the specification wherein like reference characters designate corresponding parts or portions thereof in the different views.

FIG. 1 is a plan view showing the preprinted outline of a set of patterns for the individual pieces of the garment laid out in spaced relation on the fabric material;

FIG. 2 is a plan view showing the prior art arrangement of pieces of a garment illustrating the usual close proximity of the pieces.

FIG. 3 is a chart showing the nominal sizes of the kits according to the present invention for comparison with the standard sizes associated with ready made garments;

FIG. 4 shows a second chart defining the nominal dimensions of a finished garment made from each kit; and FIG. 5 shows a pictorial view of an individual pattern piece showing the typical alterations that can be made in the dimensions to provide custom fitting of a garment to the wearer's measurements.

DETAILED DESCRIPTION OF THE EMBODIMENTS

Turning more specifically to the drawings, FIG. 1 shows a large length or piece of fabric 10 upon which the outline of the individual patterns and resulting pieces of a finished garment are shown. In this specification, for illustration purposes only, the patterns and pieces shown and described herein are for a vest-type garment in order to provide ease in description and illustration. It is to be understood that the arrangements and descriptions provided herein can also apply to any other type of garment or article such as a parka, coat, dress, trousers, sleeping bag, insulated pants or the like as may be desired.

In FIG. 1, the fabric 10 has been preprinted to show the common garment pieces; front panels 12, back panels 14, and collar pieces 16. Pockets 20 are also provided but are not essential to the garment itself. As is common practice, notches 22 can be provided for matching certain corresponding points on each piece of fabric. Each piece also has an additional $\frac{5}{8}$ inch margin around the entire edge to allow for the nominal seam or hem dimension. Thus, the pattern for the piece is larger than the actual finished dimensions. This in no way will affect the alterations that will be explained hereinbelow. The alterations will be added to the finished dimensions of the individual pieces with the $\frac{5}{8}$ inch seam or hem allowance remaining the same throughout.

It is an important feature of this invention that the individual pattern pieces which form the pieces of the garment are spaced one from the other by at least one inch at their closest point. This permits at least one inch being added to the outside edge of at least one of the two adjacent pieces. Since two edges are adjoined to form each seam, a maximum of two inches can be added to the garment at each matching seam.

The prior art arrangement of pieces of patterns on a large piece of fabric is illustrated in FIG. 2. As can be seen, typical front pieces 30, back pieces 32, collar pieces 34 and pockets 36 are laid out on the fabric in close proximity to each other. Little or no spacing is provided between the individual pieces for adding material to the pieces in order to enlarge the individual garment or portions of the garment. It is further shown on the back pieces 32 how the overall garment can only be reduced in size by cutting along various outlines representing smaller individual sizes. It is obvious that this arrangement could be used to fabricate any sizes smaller than the original size merely by adding a series of lines representing the outline of the pieces for the smaller sized garment. Nowhere in this arrangement can certain dimensions be enlarged or reduced all in the same garment in order to provide a custom fit to the individual's measurements.

FIG. 3 presents, a size comparison chart which is provided to illustrate the arrangement by which seven kits can be provided to encompass all of the various standard sizes that are generally or conventionally required. As can be seen the "child small" kit is equivalent to the child's standard 4–6 size. By the same token the "small" kit as provided herein has dimensions which not only will fit the various men's 34–36 size, but will also fit the women's 8–10 size and child's 16–18 size. In other words, this single kit corresponds to and fits all of the size ranges stated. It is important to remember that in the kit provided in the present invention the sizing and purchase is established on the basis of the chest and shoulder measurements of the individual. These are the areas which are most difficult to alter because of the complexities found in the construction and the number of seams which join and intersect in these areas. Other dimensions are easier to modify and can be changed through the use of the alterations provided in this invention.

The inside dimensions of the finished, nominal sized garment as provided herein are shown in the chart in FIG. 4. The dimensions shown are intended to be for illustration purposes only, but are typical of the dimensions that can be provided through the use of the kits. The "small" size kit has finished dimensions on the inside of the garment wherein the chest would be $41\frac{1}{2}$ inches; the circumference of the garment around the bottom edge which corresponds to the hip dimension would be 39 inches. The length of the back of the garment from the collar to the bottom edge would be 23 inches, with the circumference of the collar opening being 19 inches. These dimensions for the nominal finished garment would be obtained when made according to the instructions using the $\frac{5}{8}$ inch seam margin. Accordingly, the dimensions shown here for the finished garment are actually 4–8 inches larger than required to provide roominess for the individual wearer. Thus, the actual measurements of the individual should be at least 4 and possibly 8 inches less than the dimensions shown in this chart.

Knowing the actual finished dimensions of the garment, the individual compares his actual measurements such as hip, waist, arm length, back length, collar, etc., to the chart measurements. Where extra additional roominess is desired 6 to 8 inches would be added to the actual measurement of the wearer in that particular dimension. If a rather tight fit is desired then only 2–4 inches would be added to the actual measurement. The finished dimensions for the garment can be determined with a difference established either larger or smaller from the dimensions measurement shown for the kit. This difference determines the actual alterations that have to be made in each of the critical areas.

As an example, if the individual has a chest measurement approximating 34–36 inches he would purchase a kit according to the present invention which has a nominal size designation of "small." Thus, it is established that the finished garment if made according to the instructions, would have a finished inside dimension in the chest area of approximately 41½ inches. This is normally sufficient to provide roominess to satisfy an active person. Measuring further, if the individual has a hip measurement of 36 inches, it can be seen that an allowance of only 3 inches is available between the required dimension and the nominal finished dimension of 39 inches. It will be desirable to improve the fit of the garment by adding approximately three inches to the hip dimension to provide additional roominess.

In FIG. 5 is shown a typical front pattern piece 42 which is used as part of the construction of a vest-type garment and which would correspond to the front panel 12 as shown in FIG. 1. Dimension A is designated by the arrows shown and is intended to represent the hip area of the garment. This dimension shows that the pattern can be enlarged by adding a desired amount to the outline in the hip area. Dimension B is intended to designate a reduction of the pattern again in the same hip dimension area.

The amount to be added as determined by Dimension A is computed by determining the number of edges that are joined together to form the seams around the circumference in the hip area. The number of edges that are present, is divided into the required dimensional change such as the 3 inches illustrated above. The amount of equal material that is to be added to each edge can thus be determined. This amount is represented by the dimension shown as Figure A. This measurement is used to enlarge the pattern starting at the bottom edge and tapering upward to the sleeve opening. The line 44 represents the edge of the enlarged pattern. Each of the corresponding edges are increased by the required amount which when totaled would equal the three inch increase as required in this example.

By the same token an amount can be removed from the hip area of the garment by reducing the dimension as shown by letter B in FIG. 5. Again, a mark is made inside the outline of the garment at the bottom edge and this mark is extended upwardly as described previously to the sleeve opening. The new edge 50 shows the outline of the reduced pattern. This would be a reduction in the hip area of the finished garment. As illustrated in this specification, it is possible to alter the various critical dimensions of the finished garment by three inches or more.

Dimension C is shown to represent the material that would be needed to be added if the length of the garment is required to be extended. This dimension depending upon the length required would be added to the length of each pattern. Thus, if the garment needs to be lengthened by 2 inches then dimension C would be 2 inches and each corresponding pattern piece would be extended by that amount.

It is to be understood that the placing of the pattern pieces on the fabric material can be arranged to provide additional spacing over and above the one inch dimension previously mentioned. Thus, as much as two or three inches can be provided between the pieces to allow greater lengthening or altering of the garment as desired. By the same token the garment can be shortened or taken in, as required, by reducing the dimensions of the pattern pieces the necessary amount to reduce the overall finished dimensions.

Throughout the description of this invention it is to be remembered that the actual dimensions and sizes as shown in the charts provided herein are for illustration purposes only. These dimensions have been found to be satisfactory and provide a garment which is comfortable and functional in its use. It is possible, however, that depending upon the desired roominess and the type of garment that is being made, these dimensions may vary accordingly to provide the desired basic fit especially in the shoulder and chest areas. In addition each of the kits shown and described herein contains all of the necessary additional materials and accessories needed to fabricate and complete the kit to the satisfaction of the wearer.

The garment fabricated from the kit described herein can be of the down filled type wherein two separate layers, i.e., the inside and outside fabric is sewn together and down is added before quilting. In each section of the garment, down material or other satisfactory insulation material, can be inserted in the areas provided. Then it is quilted by sewing along the lines 24 as shown in FIG. 1. In this way an extremely comfortable and light weight garment can be provided in a comparatively inexpensive and easily made fashion.

While a custom fit garment kit has been shown and described in detail, it is obvious that this invention is not to be considered to be limited to the exact form disclosed in that changes in the detail and construction may be made therein within the scope of the invention without departing from the spirit thereof.

What is claimed is:

1. A method for fabricating a custom fit garment, the steps including:

(a) selecting a length of fabric, (b) selecting a set of pattern pieces for the desired garment which has a basic nominal size closest to the actual size of the intended wearer, (c) spacing the pattern pieces in the set on said fabric so that an excess of fabric is provided around the perimeter of each pattern piece, (d) marking the outline of the spaced pattern pieces on said fabric, (e) comparing the known dimensions of the nominal sized pattern pieces with the actual corresponding measurements of the intended wearer to determine the alteration differences required for each dimension to custom fit the finished garment to the intended wearer, (f) altering the outline of the individual pattern pieces on said fabric to correspond to the various dimensional differences determined, (g) cutting the individual garment pieces from the fabric following the altered pattern outline, and (h) joining the pieces together to form the custom fit garment.

2. A method for fabricating a custom fit garment as described in claim 1 which further includes, pre-printing the outline of the individual spaced nominal pattern pieces directly on the surface of a fabric prior to making the fabric selection.

3. A method for fabricating a custom fit garment as described in claim 1 which further includes in the comparing step:

(a) measuring the intended wearer for actual body measurements in certain areas critical to the fit of the garment, (b) determining the alteration differences between the finished dimensions of the garment using the nominal sized pattern pieces and the actual measurements of the intended wearer, (c) dividing the resultant alteration dimensional differences by the number of pattern edges corresponding to the specific garment dimension, and (d) using these dimensional differences in altering the individual corresponding dimensions of the outline of each pattern piece.

* * * * *